United States Patent [19]

Edwards

[11] Patent Number: 4,685,890

[45] Date of Patent: Aug. 11, 1987

[54] INFLATABLE LIFEJACKET

[75] Inventor: David V. Edwards, Billingshurst, England

[73] Assignee: R.F.D. Limited, Surrey, England

[21] Appl. No.: 836,718

[22] Filed: Mar. 6, 1986

[30] Foreign Application Priority Data

Mar. 6, 1985 [GB] United Kingdom ..... 8505779
Mar. 6, 1985 [GB] United Kingdom ..... 8505780

[51] Int. Cl.[4] ..... B63C 9/12

[52] U.S. Cl. ..... 441/94; 441/41; 441/92; 441/99

[58] Field of Search ..... 441/41, 92, 93, 94, 441/95, 96, 99, 100, 101, 114, 115, 116, 117, 118; 222/5

[56] References Cited

U.S. PATENT DOCUMENTS

| | | | |
|---|---|---|---|
| 1,670,591 | 5/1928 | Merifield | 441/94 |
| 2,782,430 | 2/1957 | Radnofsky | 441/94 |
| 2,823,396 | 2/1958 | Erickson | 441/94 |
| 3,002,203 | 10/1961 | Moran | 441/118 |
| 3,152,344 | 10/1964 | Radnofsky et al. | 441/94 |
| 3,329,982 | 7/1967 | Zannoni | 441/92 |
| 3,345,657 | 10/1967 | Peeler et al. | 441/92 |
| 4,416,641 | 11/1983 | Spinosa et al. | 441/94 |
| 4,551,106 | 11/1985 | Prager | 441/94 |

FOREIGN PATENT DOCUMENTS

| | | | |
|---|---|---|---|
| 721254 | 1/1955 | United Kingdom | 441/92 |

*Primary Examiner*—Joseph F. Peters, Jr.
*Assistant Examiner*—Thomas J. Brahan
*Attorney, Agent, or Firm*—Birch, Stewart, Kolasch & Birch

[57] ABSTRACT

An inflatable lifejacket for providing buoyancy in water to a wearer of the lifejacket, comprises an inflatable buoyancy envelope and an inflation unit mounted within the envelope for inflation thereof. The inflation unit comprises a storage cylinder which stores inflation gas and which is openable by an operating arm which in an inoperative disposition extends alongside the cylinder in spaced relation thereto and which when pulled away from the cylinder in an operating stroke is operative to release gas from the cylinder. The envelope includes a projecting tongue portion which receives the arm and which is so positioned in relation to an adjacent support portion of the envelope that, when the unit is assembled in a mounted disposition in the envelope with the arm located in the tongue portion, the cylinder is aligned with the adjacent support portion and is supported thereby when the arm is pulled to release gas from the cylinder.

16 Claims, 8 Drawing Figures

INFLATABLE LIFEJACKET

The present invention relates to inflatable lifejackets and is particularly although not exclusively concerned with inflatable lifejackets suitable for installing in passenger aircraft.

Airline safety regulations require the provision in a passenger aircraft of a lifejacket for each passenger and each member of the crew, which can be used in an emergency when an aircraft is forced to land in water. In such emergencies no time is available for giving last minute instruction to passengers in regard to the use of the lifejacket and the lifejacket therefore requires to be of a design which will rule out as far as is possible incorrect use of it by a passenger in an emergency. In particular, the lifejacket requires to be so constructed that it is reversible, that is to say, that it can be donned by a passenger so as to overlie the chest either way round, with all the facilities on it being equally accessible and duplicated where necessary to achieve this end. At the same time, a lifejacket for use on passenger airlines should be made as lightweight as possible to reduce the weight penalty arising from the large number required for each aircraft and consideration of this requirement needs to be taken into account in the design of an acceptable lifejacket.

Lifejackets hitherto proposed have included an inflatable buoyancy envelope and an inflation unit for supplying inflation gas to the envelope from a small storage cylinder under the control of an actuating device operated by the wearer. In an emergency landing on water, airline passengers are instructed to inflate their lifejackets after leaving the aircraft and the action required of the passenger to inflate the lifejacket must be a simple and natural one to take. It has long been considered that pulling on a cord to initiate inflation of the lifejacket best fulfils this requirement.

In a lifejacket in common use the inflation unit for supplying inflation gas to the buoyancy envelope is mounted on the outside of the envelope. It comprises a storage cylinder formed with a neck sealed by a metal closure diaphragm sufficient to withstand the pressure of the gas within the cylinder but at the same time capable of being pierced. A piercing device is provided for piercing the diaphragm and comprises a body portion into which the neck of the cylinder is screwed and an operating arm which is mounted on the body portion and which when actuated causes a piercing element to pierce the closure diaphragm. Inflation gas released from the cylinder upon actuation of the piercing device passes through the body portion of the device and into the envelope through an inlet tube which is secured in the wall of the envelope and which serves to provide support for the device and the cylinder. The operating arm is arranged to be actuated by the wearer of the jacket by pulling on a tab depending from the arm. While this arrangement has the advantage that a pulling action results in inflation of the envelope, it has the disadvantage that the inlet tube needs to pass through an opening in the envelope and to be sealed therein by welding.

In another form of lifejacket hitherto proposed, the inflation unit is housed entirely within the inflatable buoyancy envelope and comprises a storage cylinder which stores inflation gas under high pressure and which is openable by an operating arm which extends alongside the cylinder and which when pressed toward the cylinder is operative to release gas from the cylinder into the envelope. The inflation unit is housed in a location pocket formed within the envelope so that it is confined to a specific location within the envelope. The lifejacket is inflated by the wearer first locating the inflation unit by searching with his hand, then grasping the unit through the jacket and squeezing it so as to move the arm toward the cylinder. This action on the part of the wearer requires previous instruction as to the inflation procedure and is considered to be unsuitable for a lifejacket required in the special circumstances of an aircraft being forced to land on water where the evacuation of the aircraft needs to be carried out at high speed and no time is available for last minute instruction as to procedure. Furthermore, an additional pocket needs to be provided on the inside of the lifejacket envelope to locate the inflation unit.

SUMMARY OF THE INVENTION

It is an object of the present invention to provide an inflatable lifejacket which does not suffer from the disadvantages of the hitherto proposed lifejackets, which is economical to manufacture and which is particularly suitable for use in passenger aircraft.

According to the present invention, there is provided an inflatable lifejacket for providing buoyancy in water to a wearer of the lifejacket, comprising an inflatable buoyancy envelope and inflation means mounted within the envelope for inflation thereof, the inflation means comprising an inflation unit having a storage cylinder which stores inflation gas and which is openable by an operating arm which in an inoperative disposition extends alongside the cylinder in spaced relation thereto and which when pulled away from the cylinder in an operating stroke is operative to release gas from the cylinder and the envelope including a projecting tongue portion which receives the arm and which is so positioned in relation to an adjacent support portion of the envelope that, when the unit is assembled in a mounted disposition in the envelope with the arm located in the tongue portion, the cylinder is aligned with the adjacent support portion and is supported thereby when the arm is pulled to release gas from the cylinder.

In accordance with the embodiments of the invention hereinafter to be described, the envelope includes first and second sheet portions of a flexible material which overlie each other and which are joined together at their edges to form an envelope outer edge and the tongue portion and the adjacent support portion of the envelope are formed at the envelope outer edge. Preferably, the tongue portion of the envelope is so shaped and dimensioned that with the inflation unit in the mounted disposition in the envelope the tongue portion resists withdrawal of the arm therefrom.

It is sometimes necessary to meet a requirement by an authority to provide a dual buoyancy chamber lifejacket in which two buoyancy envelopes are formed, each with its own inflation unit. In use, the wearer actuates both inflation units for inflation of the two envelopes, which together provide the required buoyancy for the jacket. In the event that one of the envelopes is damaged or its inflation unit fails, inflation of the other envelope maintains the wearer adequately supported with his head above water. Topping off of the inflated envelope by means of an oral inflation tube may then be carried out to bring the lifejacket to the required buoyancy.

A lifejacket according to the present invention may readily be constructed to provide this dual inflation facility and in accordance with a preferred embodiment of the invention hereinafter to be described a further envelope is provided which overlies the first-mentioned envelope to form a dual inflation envelope assembly, together with a further inflation unit identical to the first mentioned inflation unit for inflation of the further envelope. The further envelope then includes a tongue portion which receives the operating arm of the further inflation unit and which is so positioned in relation to an adjacent support portion of the further envelope that, when the further unit is assembled in a mounted disposition in the further envelope with the arm located in the tongue portion, the cylinder of the further unit is aligned with the adjacent support portion and is supported thereby when the arm of the further unit is pulled to release gas from the cylinder of the further unit. Preferably, the further envelope is formed by a third sheet portion of a flexible material which overlies the second sheet portion of the first-mentioned envelope and which is joined at its edges to the edges of the second sheet portion to form an outer edge of the further envelope and the tongue portion of the further envelope and the adjacent support portion are formed at the outer edge of the further envelope.

In accordance with the embodiments of the invention hereinafter to be described, the lifejacket is of a form which is donned by a wearer who passes his head through an opening in the lifejacket to bring a main body portion of the lifejacket to overlie the chest with a neck portion passing round the sides and back of the neck and resting on the shoulders. The lifejacket may comprise an outer cover within which the envelope or envelope assembly is removably fitted or the envelope or envelope assembly itself may form the lifejacket.

Inflation units in common use for supplying gas for inflation of an inflatable lifejacket utilize a storage cylinder for storing just sufficient gas under high pressure for fully inflating a buoyancy chamber of the lifejacket. The storage cylinder employed is provided with a metal closure diaphragm sufficient to withstand the pressure of the gas within the cylinder but at the same time capable of being pierced. A piercing device is provided for piercing the diaphragm and comprises a support portion into which the cylinder is screwed and an operating arm which is mounted on the body portion and which when actuated causes a piercing element to pierce the closure diaphragm.

It has long been appreciated that where the piercing element remains within the opening it has produced in the diaphragm, the element needs to be so constructed as to allow the escape of gas from the cylinder. Numerous proposals have been made for achieving this end. For example, the piercing element may take the form of a solid pin with a circumferential groove at a location such that when the pin is at the end of its piercing stroke the groove provides a passage at the opening in the diaphragm for the escape of gas from the cylinder. In another proposal the piercing element is a hollow piercing pin through which gas from the cylinder escapes. In yet another arrangement, the piercing element is formed with an enlarged head portion and a shank portion of smaller cross section than the head portion so that when the element is at the end of its piercing stroke gas from the cylinder can escape through the annular space between the opening formed in the diaphragm and the shank portion of the element. Such proposals however require a piercing element of complex construction and the inflation unit is costly to manufacture.

A piercing device of less complex construction as proposed in prior British Pat. No. 1060094 comprises a pivotally mounted operating arm which extends firstly over the end of the cylinder close by the diaphragm and then downwardly from the neck alongside the cylinder. A piercing element is provided on the operating arm in the region where the arm passes over the end of the cylinder and the construction of the device is such that when the operator grasps the unit in his hand and squeezes it so that the arm is moved toward the cylinder the pivotal movement of the arm causes the piercing element to pierce the closure diaphragm on the end of the cylinder. The construction of the piercing device has however the disadvantage that the opening produced in the diaphragm by the piercing element is completely filled by the element while the arm is maintained in the operating disposition. As a result, very rapid inflation of a lifejacket may not be achieved in circumstances where the wearer of the lifejacket maintains his grasp on the operating arm.

With the object of overcoming the drawbacks of the above-mentioned prior proposals, the inflation unit in accordance with a preferred embodiment of the invention includes a piercing device for piercing a closure element on the storage cylinder to effect release of gas from the cylinder, the piercing device comprising an attachment portion which is attached to the cylinder and a piercing element which is caused in response to movement of the operating arm through its operating stroke to move in relation to the attachment portion between an inoperative disposition in which the piercing element is clear of the closure element and a piercing disposition in which it pierces the closure element in a piercing stroke in which it moves downwardly into and across the closure element to produce an opening which is larger than that taken up by the piercing element in the piercing disposition.

In the preferred embodiment of the invention hereinafter to be described, the operating arm of the inflation unit is pivotally mounted at one end on the attachment portion and extends at its other end alongside the cylinder, and the piercing element is mounted on the operating arm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
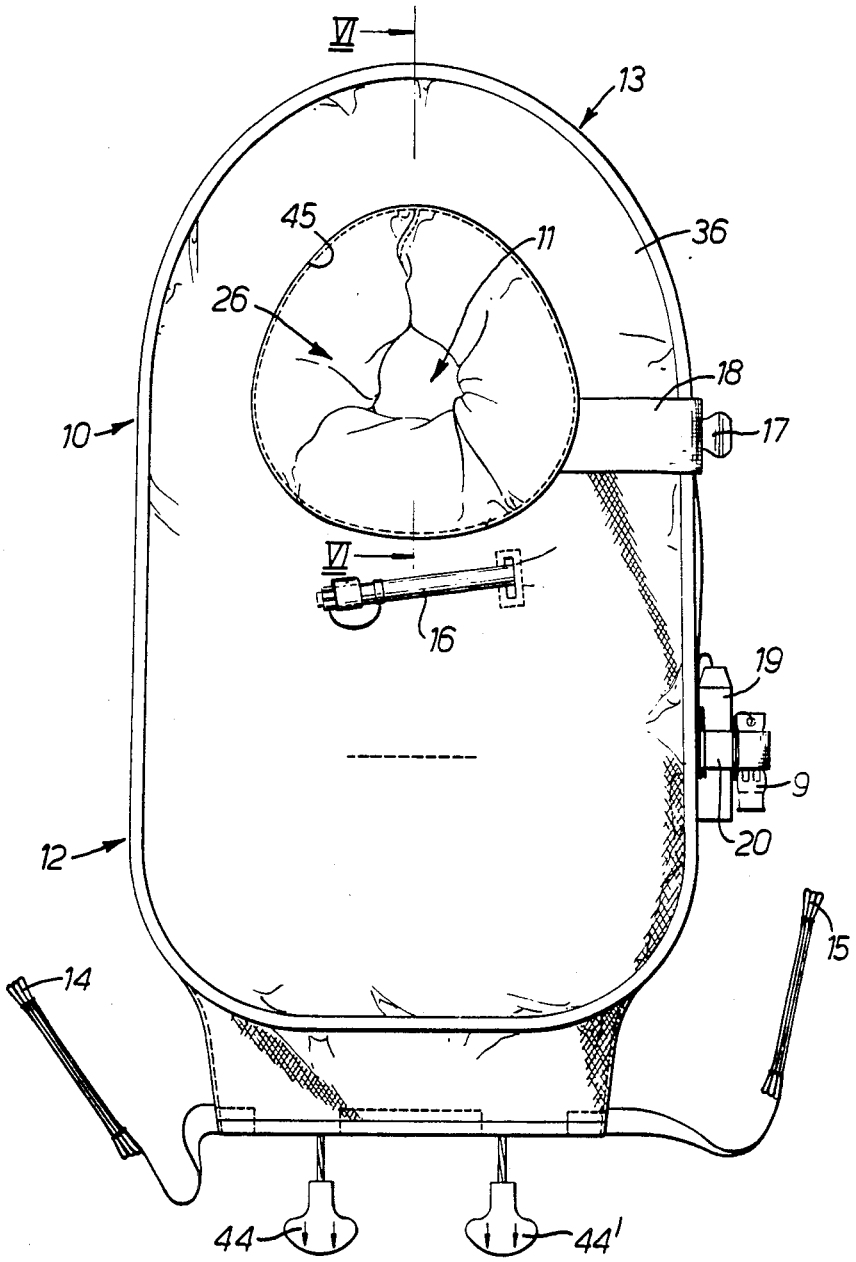
FIG. 1 is a front elevation of a lifejacket according to a first embodiment of the invention.

Referring first to FIG. 1, the lifejacket shown is of a type which is donned by a wearer who passes his head through an opening 11, bringing a main body portion 12 of the lifejacket to overlie the chest with a neck portion 13 passing round the sides and back of the neck and resting on the shoulders and who then secures the jacket in place by extending and passing tapes 14 and 15 first round his back at waist level and then bringing the ends to the front where he securely ties them together. The lifejacket has accessories, such as those conventionally provided, including a topping up tube 16 which can be brought to the mouth of the wearer for oral topping up of the lifejacket, an identical further topping up tube (not shown) provided on the other side of the lifejacket for use if the lifejacket is donned the other way around, and a lamp 17 mounted at the edge of the lifejacket on a strap 18 and supplied from a battery 19 also secured to the edge of the lifejacket by a strap 20 which also holds a whistle 9 additionally held captive by a cord (not shown).

Figure 2:
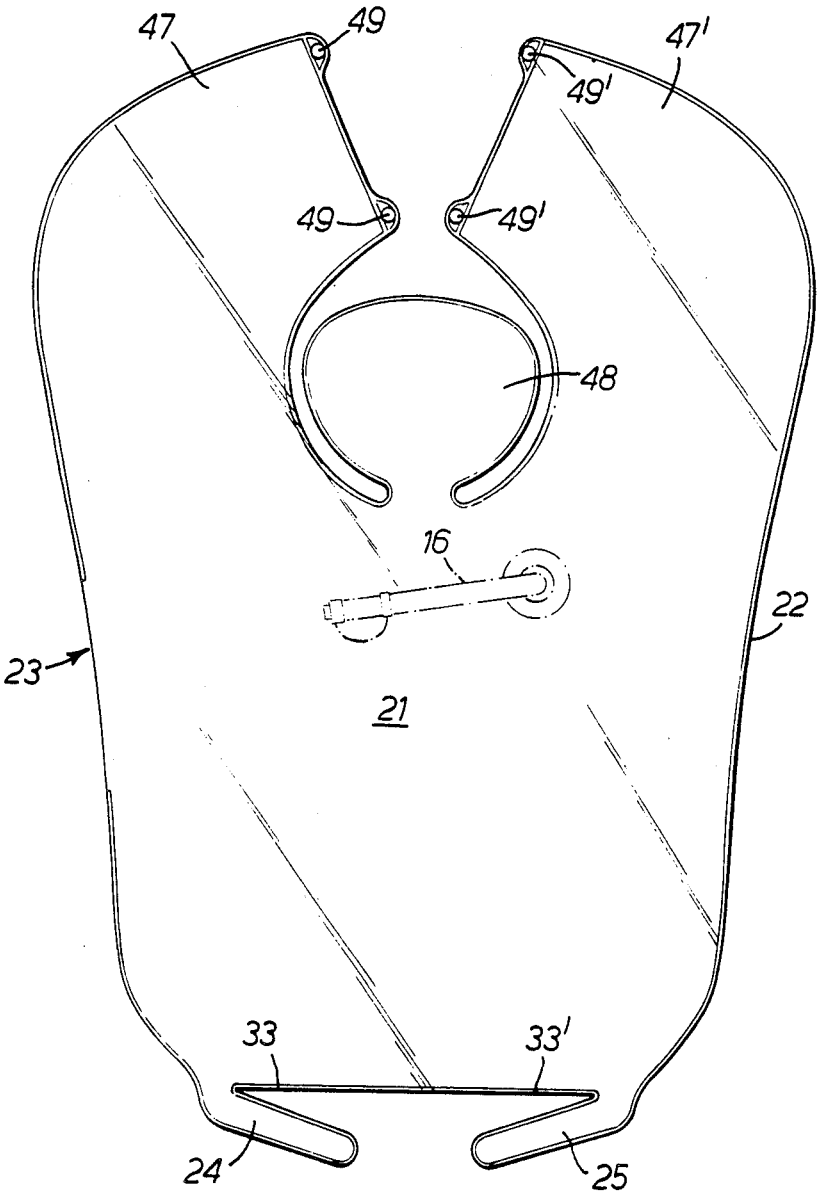
FIG. 2 is a front elevation of a dual buoyancy envelope forming part of the lifejacket shown in FIG. 1.
Figure 3:
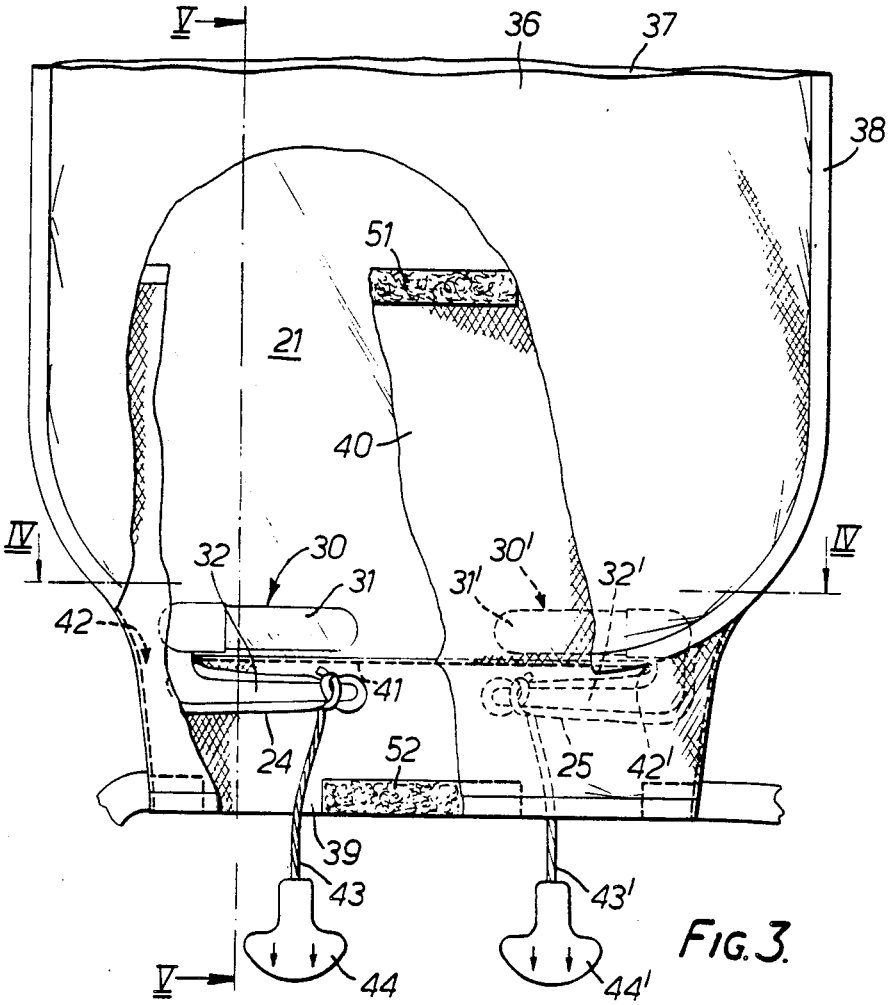
FIG. 3 is a front elevation of part of the lifejacket shown in FIG. 1, drawn to an enlarged scale and with parts of the lifejacket cut away.
Figure 4:
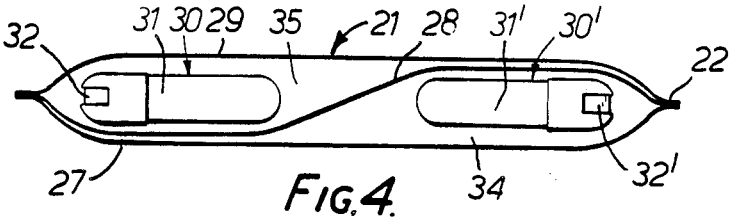
FIG. 4 is a schematic section on the line IV—IV in FIG. 3.
Figure 5:
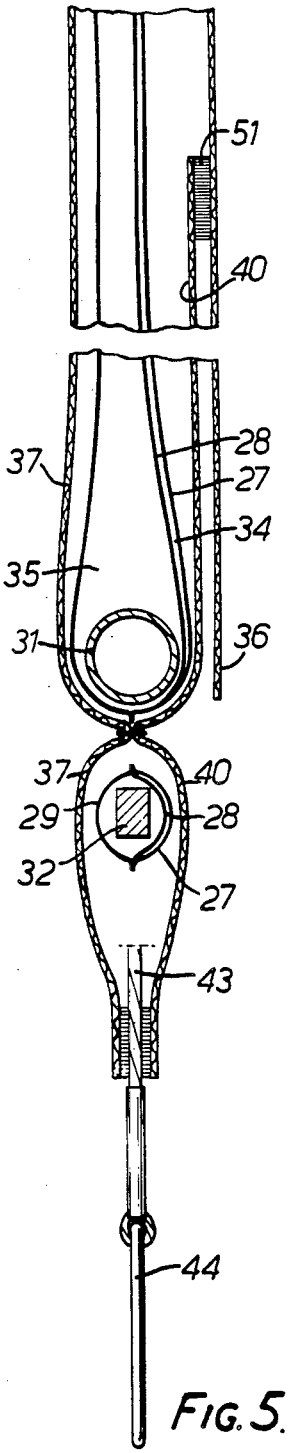
FIG. 5 is a schematic section of the lifejacket shown in FIG. 1, taken on the line V—V in FIG. 3, and drawn to an enlarged scale.

The lifejacket shown in FIG. 1 includes an inner inflatable double envelope of the form shown in FIG. 2. The double envelope, which is not seen in FIG. 1, but which is indicated by the reference numeral 21 in the other figures, serves to inflate the main body portion 12, the neck portion 13 and a collar 26. The envelope 21 is formed from three air impermeable sheets of a plastics material which overlie each other and which are joined together along their edges by welding in a single hit operation to form an envelope outer edge 22 having the contour shown in FIG. 2. The envelope 21 is left unsealed in a region 23 which allows for insertion of inflation units during assembly of the jacket and which is subsequently sealed in a separate single welding operation. As will be seen from FIG. 2, the outer edge 22 of the envelope 21 is contoured to form two tongue portions 24 and 25 located at the base of the envelope. As best seen in FIG. 4 the three sheets forming the envelope 21 comprise a front sheet 27, an intermediate sheet 28 and a back sheet 29 which are joined together at their edges to form the envelope outer edge 22. As best seen in FIG. 3 two inflation units 30 and 30′ are provided. The units are of identical construction each comprising a cylinder 31,31′ containing gas under high pressure and an operating arm 32,32′ pivotally mounted on the head of the cylinder 31,31′ and operative to release gas from the cylinder by perforation of a closure diaphragm upon movement of the arm 32,32′ away from the cylinder 31,31′.

Referring now to FIGS. 2,3 and 4, the inflation units 30,30′ are assembled in the envelope 21 in the positions shown in FIG. 3 by inserting the unit 30 between the sheets 28 and 29 in the unsealed region 23 of the envelope and manipulating the unit into a position in which the arm 32 is located within the tongue portion 24 of the envelope, with the cylinder 31 aligned with the adjacent portion 33 of the sealed edge 22. The unit 30′ is then inserted between the sheets 27 and 28 in the unsealed region 23 of the envelope and manipulated to a position in which the arm 32′ is located within the tongue portion 25 of the envelope with the cylinder 31′ aligned with the adjacent edge portion 33′ of the sealed edge 22. With the two units 30 and 30′ so assembled, the region 23 is sealed by welding to form the double envelope 21, with a front inflatable compartment 34 housing the inflation unit 30′ and a rear inflatable compartment 35 housing the inflation unit 30. Additionally, the topping up tubes 16 are mounted in the front and back sheets 27 and 29 in conventional manner. The sealed envelope 21 with its assembled inflation units 30 and 30′ is then assembled within an outer cover of the lifejacket.

Referring again to FIG. 3 the outer cover of the lifejacket is formed by front and rear fabric sheets 36 and 37 which are sewn together at their edges, except in the lower region of the jacket, where the rear sheet 37 is formed with a depending flap portion 39. An internal flap 40 of the same fabric as the sheets 36 and 37 is secured by sewing to the rear sheet 37 along the outer side edges of the sheet 37 and along a seam line 41 which extends across the lifejacket but is interrupted on each side to provide passageways 42 and 42′ between the rear sheet 37 and the flap 40. As will be seen, the flap 40 extends upwardly between the sheets 36 and 37 and downwardly so as to be co-terminus with the flap portion 39 of the rear sheet 37. The edges of the sheets 36 and 37 are for the most part protected by an edge tape 38.

The sealed double envelope 21 with its inflation units 30 and 30′ assembled as described is introduced into the lifejacket outer cover by passing it through the opening between the front sheet 36 and the flap 40. The lower end of the envelope is then placed behind the flap 40 and the tongue portions 24 and 25 carrying the operating arms 32 and 32′ are passed through the passageways 42 and 42′ so that they take up the dispositions shown in FIG. 3. The two tongue portions 24 and 25 together with the operating arms 32 and 32′ lie between the lower extension of the flap 40 and the flap portion 39 of the sheet 37. Pull cords 43 and 43′ are tied at their upper ends to the arms 32 and 32′ in regions where the arms are notched to provide secure attachment of the cords and are provided with pull tabs 44 and 44′ at their lower ends.

Figure 6:
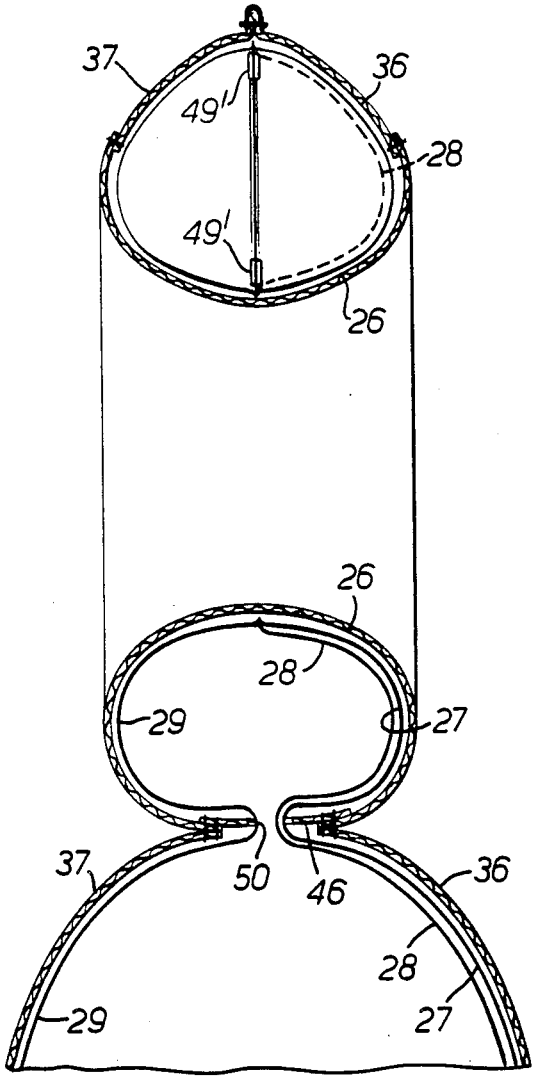
FIG. 6 is a section of the lifejacket shown in FIG. 1 taken on the line VI—VI in FIG. 1.

As best seen in FIG. 1, the front sheet 36 of the outer cover is cut away to form the opening 11 and provides an edge 45 to which the front edge of the collar 26 is sewn. Likewise the rear sheet 37 is cut away for the opening 11 and provides an edge to which the rear of the collar is sewn. While it is intended that the collar inflates with the rest of the lifejacket, it has been found necessary to restrict the degree of inflation at the front of the neck, while at the same time providing an inflatable support for the chin of the wearer. To provide for such inflation the edge 45 of the sheet 36 in the region of the chin of the wearer is, as best seen in FIG. 6, connected by an inextensible bridge portion 46 to the corresponding edge of the rear sheet 37, thereby limiting the amount by which the lifejacket distends in this region. It is however necessary to provide for limited inflation of the collar 26 in the chin region.

As will be seen from FIG. 2, the upper end of the envelope 21 is contoured to form two neck extensions 47 and 47' partially enclosing a balloon portion 48. Upon assembly of the envelope 21 within the jacket cover the neck extensions 47 and 47' are pushed into the neck regions 13 of the jacket cover and connected together by snap fasteners 49,49'. The bridge portion 46 bridging the sheets 36 and 37 in the region of the front of the neck is formed with a central opening 50 and the balloon portion 48 of the envelope 21 is pushed through the opening to provide for inflation of the collar 26 in the chin region. In this way, the envelope 21, which can be produced by simple welding operations, provides for inflation of the neck region 13 of the lifejacket as well as for controlled inflation of the collar 26 in the chin region.

As will be seen from FIG. 3, the flap 40 is provided with a velcro pad 51 which, following assembly of the envelope 21 within the outer covers 36 and 37, is brought into contact with a corresponding velcro pad provided on the front outer sheet 36. Furthermore, a velcro pad 52 provided on the flap portion 39 mates with a corresponding pad on the depending end of the flap 40 so that the two are held together, with the two cords 43 and 43' passing through openings on either side of the pad 52.

In use, the wearer dons the lifejacket as hereinbefore described. At an appropriate time, he then proceeds to inflate it by pulling down hard on the tabs 44 and 44'. When the tab 44 is pulled, the operating arm 32 is pivoted downwardly away from the cylinder 31, which is held by the adjacent portion of the edge 22 of the envelope and by the stitching along the seam line 41 joining the flap 40 to the rear outer cover sheet 37. In a preferred form of inflation unit as hereinafter to be described with reference to FIGS. 7 and 8 pivoting of the arm 32 results first in shearing of a shear pin and then piercing of a closure diaphragm on the cylinder 31, whereupon gas under high pressure is released from the cylinder 31 to fill the envelope compartment 35. In the same manner, when the other tab 44' is pulled gas from the cylinder 31' is released to fill the envelope compartment 34. If, say, the inflation unit 30 fails to operate or if the rear inflation compartment 35 is ruptured and loses inflation the intermediate sheet 28 of the envelope 21 is pushed by the inflation gas in the compartment 34 into contact with the front sheet 27. The wearer of the jacket is nevertheless adequately supported in the water as inflation of either of the compartments 34 and 35 is arranged to be sufficient to support a wearer of the lifejacket with his head above water. Subsequent topping up of the compartment 34 by means of the oral inflation tube will then completely fill out the lifejacket to its designed shape and provide the required additional buoyancy.

It will be apparent that in the lifejacket hereinbefore described with reference to the drawings the inner envelope 21 is of simple form and comprises simply three sheets of a plastics material welded together by simple single hit welding operations. The contour of the envelope provides the tongue portions 24 and 25 which serve to locate the inflation units 30 and 30' within the envelope and the arrangement of the assembled inflation units within the envelope facilitates operation of them by pulling on the arms 32 and 32' using the tabs 44 and 44'.

Figure 7:
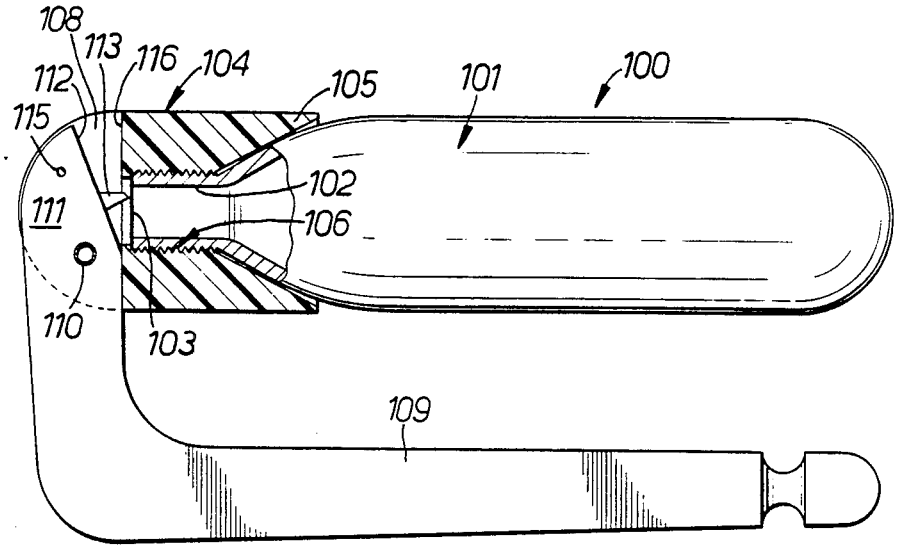
FIG. 7 is a side elevation of a pressurised-gas inflation unit for use in inflating the inflatable lifejacket shown in FIG. 1.
Figure 8:
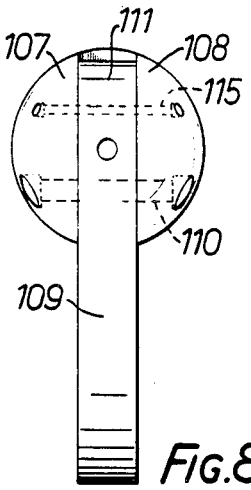
FIG. 8 is an end elevation of the unit shown in FIG. 7.

An inflation unit now to be described with reference to FIGS. 7 and 8 is particularly suitable for use in the inflation of the lifejacket hereinbefore described with reference to FIGS. 1 to 6.

Referring now to FIGS. 7 and 8, an inflation unit 100 is shown which includes a storage cylinder 101 containing an inflation gas, such as carbon dioxide, under high pressure. The cylinder 101 is formed with an externally screw-threaded neck 102, the end of which is closed by a metal closure diaphragm 103. A piercing device 104 is provided for piercing the diaphragm 103 to effect release of gas from the container 101. The device 104 includes a body portion 105 formed with a screw-threaded axial bore 106 into which is screwed the neck 102 of the cylinder 101. The body portion 105 is formed with shoulders 107 and 108 and an operating arm 109 is pivotally mounted between the shoulders 107 and 108 on a pivot pin 110 supported by the shoulders 107 and 108 and passing through a head portion 111 of the operating arm 109. The head portion 111 is formed with an inclined face 112 in which is mounted a piercing element 113. The operating arm 109 extends from the head portion 111 firstly away from the body portion 105 and then alongside the cylinder 101 as shown. A shear pin 115 supported by the shoulders 107 and 108 passes through the head portion 111 of the operating arm 109 to hold it in the position shown in FIG. 7.

It will be seen from FIG. 7 that with the operating arm 109 in the position shown, the piercing element 113 is in proximity to but spaced from the closure diaphragm 103. The operating arm 109 is held in this position by the shear pin 115 which prevents inadvertent operation. To effect release of gas from the cylinder 101 the arm 109 is pulled away from the cylinder 101 to shear the pin 115 and cause the head 111 to pivot on the pivot pin 110 from the inoperative position shown in FIG. 7 to a position in which the end of the face 112 of the head 111 bears on an end face 116 of the body portion 105. During this movement of the head 111, the piercing element 113 moves through a piercing stroke, determined by its disposition in relation to the pivot pin 110, in which it moves into and across the diaphragm 103 producing an opening in the diaphragm 103 which is larger than that taken up by the piercing element 113 at the end of its piercing stroke. The gas under pressure in the cylinder 101 is thereby rapidly released through the opening cut by the piercing element 113 without the need for withdrawing it from the opening by returning the operating arm 109 to the position shown in FIG. 7.

In the embodiment of the invention hereinbefore described with reference to the drawings the envelope 21 is housed within an outer cover formed by cover sheets 36 and 37, collar 26 and flap 40. It will however be appreciated that for some purposes the envelope 21 may itself form the lifejacket and no provision made for an outer cover. In this event, depending flaps may be formed on the envelope to shield the projecting tongue portions 24 and 25 and the operating arms 32 and 32' located within them.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An inflatable lifejacket for providing buoyancy in water to a wearer of the lifejacket, comprising an inflatable buoyancy envelope and inflation means mounted within the envelope for inflation thereof, the inflation means comprising an inflation unit having a storage cylinder which stores inflation gas and which is openable by an operating arm which in an inoperative disposition extends alongside the cylinder in spaced relation thereto and which when pulled away from the cylinder in an operating stroke is operative to release gas from the cylinder and the envelope including a projecting tongue portion which receives the arm and which is so positioned in relation to an adjacent support portion of the envelope that, when the unit is assembled in a mounted position in the envelope with the arm located in the tongue portion, the cylinder is aligned with the adjacent support portion and is supported thereby when the arm is pulled to release gas from the cylinder.

2. A lifejacket according to claim 1, wherein the envelope includes first and second sheet portions of a flexible material which overlie each other and which are joined together at their edges to form an envelope outer edge and wherein the tongue portion and the adjacent support portion of the envelope are formed at the envelope outer edge.

3. A lifejacket according to claim 2, wherein the tongue portion of the envelope is so shaped and dimensioned that with the inflation unit in the mounted position in the envelope the tongue portion resists withdrawal of the arm therefrom.

4. A lifejacket according to claim 2, wherein the lifejacket is provided with a further envelope which overlies the first-mentioned envelope to form a dual inflation envelope assembly and a further inflation unit identical to the first mentioned inflation unit for inflation of the further envelope and wherein the further envelope includes a tongue portion which receives the operating arm of the further inflation unit and which is so positioned in relation to an adjacent support portion of the further envelope that, when the further unit is assembled in a mounted disposition in the further envelope with the arm located in the tongue portion, the cylinder of the further unit is aligned with the adjacent support portion and is supported thereby when the arm of the further unit is pulled to release gas from the cylinder of the further unit.

5. A lifejacket according to claim 4, wherein the further envelope is formed by a third sheet portion of a flexible material which overlies the second sheet portion of the first-mentioned envelope and which is joined at its edges to the edges of the second sheet portion to form an outer edge of the further envelope and wherein the tongue portion of the further envelope and the adjacent support portion are formed at the outer edge of the further envelope.

6. A lifejacket according to claim 2, wherein the envelope outer edge is contoured to form the tongue portion.

7. A lifejacket according to claim 1, wherein the lifejacket comprises an outer cover within which the envelope is removably fitted.

8. A lifejacket according to claim 7, wherein the lifejacket is of a form which is donned by a wearer who passes his head through an opening in the lifejacket to bring a main body portion of the lifejacket to overlie the chest with a neck portion passing round the sides and back of the neck and resting on the shoulders, and wherein the envelope is contoured to provide inflation of the main body portion and the neck portion of the outer cover.

9. A lifejacket according to claim 8, wherein the outer cover is contoured to form the opening and to define the body portion and the neck portion of the lifejacket and wherein the envelope is contoured to form a body portion and two neck extensions which define an opening corresponding to the opening in the outer cover and wherein the two neck extensions are inserted into the neck portion of the outer cover and their ends connected together to provide for inflation of the neck portion of the outer cover.

10. A lifejacket according to claim 9, wherein the envelope is contoured to provide within the outer cover in the region of the front of the neck of the wearer of the lifejacket a balloon portion which upon inflation of the lifejacket provides support for the chin of the wearer.

11. A lifejacket according to claim 10, wherein the outer cover of the lifejacket is formed with a distensible collar portion at the opening and an inextensible bridge portion in the region of the chin of the wearer to limit the amount by which the collar portion distends in the chin region, and wherein the bridge portion is formed with an opening through which the balloon portion is passed for location within the collar portion of the outer cover in the region of the chin of the wearer.

12. A lifejacket according to claim 8, wherein. the tongue portion is located at the lower edge of the main body portion of the envelope.

13. A lifejacket according to claim 1, wherein the envelope forms the lifejacket and is donned by a wearer who passes his head through an opening in the envelope to bring a main body portion of the envelope to overlie the chest with a neck portion passing round the sides and back of the neck and resting on the shoulders.

14. A lifejacket according to claim 1, wherein the sheet portions of the envelope are of a plastics material welded together along the envelope outer edge.

15. A lifejacket according to claim 1, wherein the inflation unit includes a piercing device for piercing a closure element on the storage cylinder to effect release of gas from the cylinder, the piercing device comprising an attachment portion which is attached to the cylinder and a piercing element which is caused in response to movement of the operating arm through its operating stroke to move in relation to the attachment portion between an inoperative position in which the piercing element is clear of the closure element and a piercing position in which it pierces the closure element in a piercing stroke in which it moves downwardly into and across the closure element to produce an opening which is larger than that taken up by the piercing element in the piercing position.

16. A lifejacket according to claim 15, wherein the operating arm is pivotally mounted at one end on the attachment portion and extends at its other end alongside the cylinder, and wherein the piercing element is mounted on the operating arm.

* * * * *